US012564210B2

(12) United States Patent
Björkholm et al.

(10) Patent No.: US 12,564,210 B2
(45) Date of Patent: Mar. 3, 2026

(54) POWDER COMPOSITION

(71) Applicant: LIW INNOVATION AB, Hökerum (SE)

(72) Inventors: Johan Björkholm, Ulricehamn (SE); Lars Björkholm, Borås (SE)

(73) Assignee: LIW INNOVATION AB, Hökerum (SE)

( * ) Notice: Subject to any disclaimer, the term of this patent is extended or adjusted under 35 U.S.C. 154(b) by 392 days.

(21) Appl. No.: 18/265,921

(22) PCT Filed: Dec. 16, 2021

(86) PCT No.: PCT/SE2021/051268
§ 371 (c)(1),
(2) Date: Jun. 7, 2023

(87) PCT Pub. No.: WO2022/132018
PCT Pub. Date: Jun. 23, 2022

(65) Prior Publication Data

US 2024/0041089 A1 Feb. 8, 2024

(30) Foreign Application Priority Data

Dec. 16, 2020 (SE) ..... 2051472-5

(51) Int. Cl.
*A24B 13/00* (2006.01)
*A24B 15/28* (2006.01)
*A24B 15/32* (2006.01)
*A24B 15/40* (2006.01)

(52) U.S. Cl.
CPC ..... *A24B 13/00* (2013.01); *A24B 15/285* (2013.01); *A24B 15/32* (2013.01); *A24B 15/403* (2013.01)

(58) Field of Classification Search
CPC ..... A24B 13/00; A24B 15/285; A24B 15/32; A24B 15/403; A24B 15/30; A61K 31/045; A61K 31/352; A61K 31/465
See application file for complete search history.

(56) References Cited

U.S. PATENT DOCUMENTS 4,579,858 A 4/1986 Fernoe
4,613,500 A * 9/1986 Suzuki ..... A61K 9/0043 514/10.9
4,655,231 A 4/1987 Ray
5,935,604 A 8/1999 Illum
8,741,348 B2 6/2014 Hansson
2017/0020183 A1* 1/2017 Björkholm ..... A24B 15/28
2020/0196658 A1 6/2020 McClanahan et al.
2020/0305496 A1 10/2020 Gessesse

FOREIGN PATENT DOCUMENTS

| | | | |
|---|---|---|---|
| CA | 2173504 | A1 | 5/1995 |
| EP | 0943326 | A1 | 9/1999 |
| EP | 1025859 | A1 | 8/2000 |
| EP | 1785145 | A1 | 5/2007 |
| EP | 2116264 | A1 | 11/2009 |
| EP | 2691096 | B1 | 7/2016 |
| EP | 3192380 | B1 | 11/2020 |
| WO | 9109599 | A1 | 7/1991 |
| WO | 9427576 | A1 | 12/1994 |
| WO | 9512399 | A1 | 5/1995 |
| WO | 2010131486 | A1 | 11/2010 |
| WO | 2020/227489 | A1 | 11/2020 |
| WO | 2020247638 | A1 | 12/2020 |
| WO | 2021201765 | A1 | 10/2021 |
| WO | 2021225509 | A1 | 11/2021 |

OTHER PUBLICATIONS

International Search Report from corresponding International Application No. PCT/SE2021/051268, mailed on Jan. 17, 2022, 6 pages.
Washington, N. et al., "Determination of baseline human nasal pH and the effect of intranasally administered buffers," International Journal of Pharmaceutics, vol. 198 (2000). 139-146, Nov. 24, 1999.
Office Action and Search Report from corresponding Swedish Application No. 2051472-5, Jul. 12, 2021, 8 pages.

* cited by examiner

*Primary Examiner* — Michael H. Wilson
*Assistant Examiner* — Jennifer A Kessie
(74) *Attorney, Agent, or Firm* — Tucker Ellis LLP

(57) ABSTRACT

Disclosed are powder compositions with a pH of at least 6 for delivery of an active agent to the nasal cavity, wherein the active agent is selected from at least one of nicotine, tetrahydrocannabinol (THC) and ethanol. The compositions comprise a filling agent of water soluble and water insoluble microcrystalline cellulose and a matrix forming agent and have a defined brightness and particle size range. Also disclosed are products including the powder compositions and support particles inducing a desired property to the product.

23 Claims, No Drawings

POWDER COMPOSITION

TECHNICAL FIELD

The present invention generally relates to powder particle compositions with a pH of at least 6 for delivery of an active agent to the nasal cavity, the composition comprises, a filling agent and optionally a matrix forming agent and has desirable brightness and particle size.

BACKGROUND OF THE INVENTION

Powdered tobacco from tobacco leaves inhaled into the nasal cavity has a long history, although its popularity has declined until recent decades when the demand of smokeless nicotine products has increased. Tobacco based nasal products normally contains grinded tobacco, aroma and a certain amount of water. In English literature this type of product normally is termed "snuff" or "nasal snuff", while wet powdered products for oral consumption at least in Scandinavian countries are termed "snus". In the area of smokeless nicotine products, useful for individuals dependent on conventional tobacco products, or patients relying on nicotine as a therapy, it is an increasing demand for products essentially or completely free from tobacco having a white appearance. In the development of such products, it is a challenge to meet the requirement of resembling a conventional tobacco based product in user compliance, while stabilizing nicotine from degradation and obtaining a desirable nicotine release profile and ultimately a desirable nicotine uptake to circulatory system of the user.

U.S. Pat. No. 8,741,348 (Niconovum AB) discloses a tobacco free nicotine containing material with a particulate excipient from microcrystalline cellulose loaded with nicotine in the porous particles. EP 2691096 B1 (TillCe AB) discloses a tobacco-free dry product for oral delivery of nicotine with a storage stable free nicotine salt, a pH adjuster and a filler, such as microcrystalline cellulose. It is obvious that these disclosures refer to oral products specially adapted for consumption through the oral cavity. U.S. Pat. No. 5,935,604 (Danbiosyst) discloses a nasal nicotine microsphere delivery system with nicotine bound to a bioadhesive ion exchange polymer such as gellan or alginate or their mixtures. U.S. Pat. No. 4,655,231 (Advanced Tobacco Products) discloses an improved snuff useful in the nasal application of nicotine that comprise pure, powdered nicotine salt, an organic acid, such as oxalic acid and a diluent, such as organic sugars. There is no disclosure therein of how the improved snuff performs to deliver the nicotine through nasal membranes of the user. It is obvious that there is a need for a white nicotine delivering product adapted for nasal use that complies well with traditional tobacco-based products, stabilizes nicotine throughout shipping and storage of the product and has a delivery and release profile of nicotine complying with conventional tobacco products.

DESCRIPTION OF THE INVENTION

It is an object of the present invention to provide nasal product for nicotine delivery that considers the large extension of the nasal mucosa and admits a controlled and evenly distributed active agent uptake.

It is another object of the present invention that provides for a nasal nicotine product that delivers nicotine to the nasal mucosa with a fast onset to comply with user satisfaction compliant with similar, conventional tobacco products An object of the present invention is to provides for a product that does not discolour the user's fingers, does leave none or discreet residues and generally is more discreet than conventional nasal tobacco.

It is an object of the invention to provide a powdered nasal product that for nicotine delivery comprising powder particles with an average size that avoid inadvertent distribution to the pulmonary region, for example by aerosolization.

It is also an object of the invention to provide nasal product for nicotine delivery that has a high compliance with the nasal mucosa and that minimizes dryness, irritation, and other side-effects from long term use.

In general terms, the invention relates to powder particle compositions with an ISO brightness that is not less than about 60, preferably not less than about 70, and more preferably not less than about 80, as measured according to ISO 2470-1:2016, and with a pH of at least 6 for delivery of an active agent to the nasal cavity, wherein the active agent is selected from at least one of nicotine, tetrahydrocannabinol (THC) and ethanol. The compositions comprise a filling agent, a matrix forming agent have a water content of 30 wt % or less, preferably from 1 to 20 wt % more preferably from 5 to 15 wt %. Further the compositions comprise at least one water insoluble microcrystalline cellulose (MCC) and at least water-soluble microcrystalline cellulose (MCC).

The ISO brightness according to the standard referred to is standardized test outlined in ISO 2470-1:2016, measuring the reflectance of material such as paper a specific wavelength of blue light and is measured in a scale from 0-100.

In embodiments, the compositions comprise at least 60 wt % filling agent, preferably 60 to 90 wt % filling agent.

The filling agent comprises a combination of water soluble and water insoluble cellulose, preferably a combination of a water soluble and a water insoluble microcrystalline cellulose (MCC). In embodiments, the filling agent comprises 5 to 90 wt % of water insoluble MCC and 5 to 90 wt % of water soluble MCC, preferably 10 to wt % of water insoluble MCC and 10 to 90 wt % of water soluble MCC and more preferably 45 to 55 wt % of water insoluble MCC and 45 to 55 wt % of water soluble MCC.

Suitable water insoluble microcrystalline celluloses (MCC) can be selected from AVICEL® grades PH-100, PH-102, PH-103, PH-105, PH-112, PH-113, PH-200, PH-300, PH-302, VIVACEL® grades 101, 102, 12, 20; EMOCEL® grades 50M and HiCel® grades, such as HiCel® 90M and the like, and mixtures thereof.

Water-soluble microcrystalline celluloses are conventional water insoluble MCCs processed to improve their capacity to form colloidal sol gels. The skilled person is aware of suitable such water soluble MCCs. A suitable grade of colloid microcrystalline cellulose is the grade with Cas No. 51395-75-6 which is a mixture of MCC with cellulose carboxymethyl ether sodium salt. Other suitable water soluble MCCs are found among grades of TABULOSE®, XW-591 from Huzhou City Linghu Xinwang Chemical and FEIYUN XW59.

In certain embodiments, the filling agent further comprises a natural or synthetic fiber material, preferably the fiber material is a biopolymer or a natural fiber selected from one or more fibers from plants, trees fungi and algae.

In embodiments, the filling agent comprises tobacco fibers in amount of 0.05 to 20 wt %, preferably the tobacco fibers are obtained from a bleached and/or washed tobacco raw material or microencapsulated tobacco.

For the filling agent, biopolymers can in embodiments include any polymer that can, as such, directly be extracted or otherwise isolated from renewable natural resources. Examples thereof are polysaccharides and polypeptides.

Post-modification of the polysaccharides or proteins by chemical and/or physical means is considered to be comprised in this class of biopolymers. Moreover, biopolymers can in aspect include polymers that are obtained by non-natural (i.e. industrial) polymerization of natural monomers or oligomers, i.e. monomers or oligomers produced from renewable resources. Examples thereof include poly(lactic acid). Further, biopolymers as used herein include polymers obtained by biotechnological production, possibly but not necessarily including genetic modification of production organisms, from natural resources. Examples thereof comprise polyhydroxyalkanoates produced by suitable micro-organisms. In addition, other biodegradable, synthetic polymers can be used. Examples thereof include aliphatic polyesters and polyester-amides, polycapro-lactone and the like.

The plant fibers of the filling agent can be derived from one of tea, coffee, tobacco, cannabis cocoa, maize, bamboo, oat, barley, rye, sugar beets, herbs, buckwheat, potatoes, tomatoes, aubergines, cauliflower, apples, yerba mate or cellulose fibers various sources and the similar. The plant fibers can be natural or modified with various biological or chemicals methods. The tobacco fibers may be processed according to various conventional technologies for whiteness and/or reduction of nitrosamines. The tobacco fibers can be obtained from a bleached, washed or otherwise treated tobacco raw material which may or may not retain natural amounts of nicotine. Suitable bleaching tobacco processes are found in US20130276801 and WO2015150506. Such processed tobacco fibers have advantageously low levels of potentially harmful agents, such as nitrosamines, benzopyrenes. and certain metals.

In embodiments of the invention, the filling agent can further comprise a mucoadhesive agent selected from at least one of a cellulose derivative, a starch derivative and polyvinylpyrrolidone, preferably the mucoadhesive agent is selected from at least one of sodium starch glycolate and crosslinked polyvinylpyrrolidone.

In embodiments the filling agent can comprise a guar gum or a starch. Suitable starches are corn starch, pregelatinized starch, hydroxypropyl starch and modified or unmodified starch.

In embodiments, the filling agent may also comprise a food or pharmaceutical grade polyol selected from at least one of mannitol, sorbitol, xylitol, erythritol, lactitol, maltitol, preferably the polyol is mannitol. The filling agent may comprise up to 50 wt % of the polyol, most preferably the polyol is mannitol.

In embodiments of the invention, the composition comprises powder particles with a controlled average size (diameter) of such as from 0.05 to 0.5 mm, or 0.02 to mm, or 0.01 to 0.1 mm. For the compositions, the powder particle size is preferably optimized with considerations to avoid aerosolization and to risk inadvertent powder distribution to the lungs when particles approach <10 μm in size and to avoid insufficient compliance and distribution with large particles exceeding about a few millimetres in size.

In embodiments of the powder composition, it comprises a matrix forming agent is a gelling agent, suitably a gelling polysaccharide, preferably selected from at least one of alginate and salts thereof, β-glucan comprising various grades of β(1-3) β(1-4) glucan, xanthan, carrageenan, methyl cellulose, cudlan and pullulan. The matrix forming agent in the present invention shall be able to form a cohesive matrix in the presence of the filling agent and also in preferred aspects to contribute to stabilize the active agent from degradation throughout production and/or storage of the final composition.

In one embodiment, the inventive compositions comprise 0.5 to 10% (wt) of the matrix forming agent, and preferably at least 60 wt % of the filling agent.

The matrix forming preferably comprises a salt of alginate, such as sodium alginate. Generally, suitable alginates for the invention are alginate salts of monovalent cations that are soluble in cold water and have a low viscosity. The skilled person is capable of selecting alginates with different viscosity, solubility and molecular weight in order to modify dissolution in water and also in the oral or nasal cavities. Suitable alginates have a viscosity of 350 to 550 mPas at concentration of 1% sol. A suitable brand is Satialgine® S 900 NS, but persons skilled in the art can find other alternatives. The alginate LFR 5/60 from Protanall® is example of low viscosity alginate and Protanal® LF 10/60 (FMC BioPolymer) is an example of an alginate with higher viscosity. In order to obtain suitable dissolution and release profiles, it may be suitable to mix alginates with different viscosities. Alginate salts of divalent cations, for example Ca are generally less soluble and can be used in the inventive compositions in order to support specific release profiles the active agent, preferably in combination with one or more alginate salts of monovalent cations.

The inventive compositions can comprise a lubricating agent, preferably the lubricating agent is at least one of glycerol and propylene glycol, more preferably the lubricating agent is present in an amount 1 to 5 wt %

In embodiments, the inventive compositions comprise 0.05 to 5 wt % of nicotine. The term nicotine includes synthetic nicotine and nicotine extracts from tobacco plants such as the genus *Nicotiana* or other plant sources and includes nicotine or a nicotine derivative in any solid or liquid form such as, e.g., physical form like amorphous, crystalline, polymorphous etc. or chemical form like isomers and enantiomers etc. as well as any pharmaceutically acceptable salt, complex or solvate thereof. The term nicotine herein also includes nicotine base and/or salts thereof, such as nicotine hydrochloride, nicotine dihydrochloride, nicotine monotartrate, nicotine bitartrate, nicotine sulphate, nicotine zinc chloride (monohydrate) and nicotine salicylate the nicotine is selected from at least of one of nicotine base, and/or salts of nicotine, including nicotine hydrochloride, nicotine dihydrochloride, nicotine monotartrate, nicotine bitartrate, nicotine sulphate, nicotine zinc chloride (monohydrate) or nicotine salicylate.

In embodiments, the powder composition can comprise powdered ethanol, as conventionally produced by microencapsulation and spray drying. Accordingly, persons skilled in the art knows about several such products and processes of obtaining the products.

The compositions according to the invention further comprises at least one excipient selected from plasticizers, pH adjusters, preservatives, taste or flavor enhancers, coloring agents and sweeteners.

The plasticizer can be e.g., Polyethylene glycols, propylene glycols, glycerol and sorbitol. A preferred plasticizer is sorbitol, optionally together with a part of glycerol.

The pH adjuster is capable of maintaining a pH of at least 6 in the compositions and is exemplified by carbonates including monocarbonate, bicarbonate and sesquicarbonate, and other alkali/alkaline metal salts of physiologically acceptable acids such as acetates, glycinates, gluconates, borates, glycerophosphates or weak organic acids such as citric acid, phosphates, metal hydroxides such as sodium hydroxide and potassium hydroxide, and mixtures thereof. Examples of suitable pH adjusters are sodium bicarbonate and sodium carbonate, and mixtures thereof. It is preferable that the pH is higher at production of the compositions, such as a pH of 8 to 9, but the pH adjuster shall be capable of keeping the pH>6.5 throughout storage and consumption.

A preservative can be selected from selected from approved agents in food and pharmaceutical industry such as sorbic acid, sorbates, benzoic acid lactic acid and physiologically acceptable salts. A preferred preservative is potassium sorbate.

In embodiments, the compositions can comprise an antioxidant effective at a pH of at least 6, preferably the antioxidant is a complex binding antioxidant, preferably selected from at least one of alkali and/or alkaline earth metal salts of ascorbate, calcium citrates, calcium lactates, calcium maleates, calcium tartrates, Ca-diNa-EDTA, calcium phosphates and ammonium citrates, more preferably the antioxidant is calcium ascorbate.

Taste or flavor enhancers include ammonium chloride, essential oils including distillations, solvent extractions or cold expressions of chopped flowers, leaves, peel or pulped whole fruit comprising mixtures of alcohols, esters, aldehydes and lactones or essences including either diluted solutions of essential oils or mixtures of synthetic chemical blends to match the desired flavor from for examples bergamot, eucalyptus, orange, mandarin, citrus, lemon, peppermint, mint, menthol, liquorice, wintergreen, tobacco, coffee, vanilla, lime, apple, peach and mixtures thereof. Further examples include artificial and natural flavors of brews and liquors, e.g., cognac, whiskey, rom, gin, sherry, port, and wine; eucalyptus, liquorice, and menthol. Coloring agents can be selected from dyes containing chemical groups which absorb light including dyes, such as indigo carmine, amaranth, erythrosine, carbon black, titanium dioxide and any mixtures thereof. Sweeteners or texture improves can be natural sweeteners which are not fermentable in the mouth, or artificial sweeteners such as e.g., aspartame, acesulfame K, saccharin, cyclamates, *Stevia* extracts and other similar agents.

In embodiments of the invention, the powder composition has an ISO brightness that is not less than about 60, preferably not less than about 70, and more preferably not less than about 80, as measured according to ISO 2470-1: 2016; an average particle size of about 0.1 mm (about 90 μm); a pH of 8-9 and comprises: at least 60% (wt), preferably 80 to 90% of water insoluble or water-insoluble MCC, or mixtures thereof; 5-10% wt % water; 0.5-5 wt % sodium alginate or beta-glucan; sodium chloride; up to 1.5 wt % nicotine, 0.3% wt sodium bicarbonate; lubricating agent; and sweetener. Non-specified agents can be selected as above.

In another general aspect, the invention relates to a product for nasal use comprising any previously described powder particle composition and a fraction of support particles free from active agent and capable of adding at least one characteristic to the product selected from one or more of visual appearance, rheology, lubrication of the nasal cavity, and/or regulation of the uptake of active agent. Preferably the product comprises 1 to 5 wt % of the support particles. In this context, rheology means physical characteristics of the product, such as, but not limited to flowability, cohesiveness and user compliance.

In one aspect of the product for nasal use, the particles of the powder particle composition and the support particles have the same average size and comprises the same filling agent. The support particles can comprise complementary agents such as lubrication agents (as previously defined), one or more surfactants/wetting agents or other agents beneficial for the nasal mucosa, or other agents that contribute to regulate the uptake of active agent from nasal mucosa to the blood stream. The support particles can in some applications be provided with a controlled release barrier.

In another aspect of the nasal product, the support particles comprise microcapsules, preferably having an average size of 10 to 1000 μm, preferably the microcapsules are water insoluble and comprise a coloring agent.

In suitable embodiments of the invention the powder particle compositions are capable of delivering at least 20 wt % of the active agent within 5 to minutes when administered to a wet or moist surface. Accordingly, the compositions may deliver at least 20% wt such as 20-30 wt % of the total amount of nicotine within 5 to 10 minutes following administration to the nasal cavity.

In another general aspect, the invention is directed to methods of producing batches of the earlier described powder particle compositions.

A first method comprises the steps of:

dry mixing a filling agent, a matrix forming agent, a lubrication agent and optionally sodium chloride;

adding an aqueous solution of a pH-adjuster and mixing to homogeneity;

adding an aqueous solution of an active agent optionally comprising one or more of a sweetener, a taste or flavor enhancer and mixing to homogeneity; and collecting the resulting powder composition.

A second method comprises the steps of:

dry mixing a filling agent, lubrication agent and optionally sodium chloride;

adding an aqueous solution of a pH-adjuster and mixing to homogeneity;

adding an aqueous solution comprising a sweetener, and optionally a taste or flavor enhancer and mixing to homogeneity;

adding an aqueous solution of active agent and a matrix forming agent and optionally a taste or flavor enhancer and mixing to homogeneity; and collecting the resulting powder composition.

A third method comprises the steps of:

dry mixing a water-soluble filling agent, lubrication agent and optionally sodium chloride:

adding an aqueous solution of a pH-adjuster and mixing to homogeneity:

aqueous solution of a sweetener, a preservative and optionally a taste or flavor enhancer and mixing to homogeneity;

adding an aqueous solution of an active agent and a matrix forming agent and optionally a taste or flavor enhancer and mixing to homogeneity; and collecting the resulting powder composition.

A fourth method comprises the steps of:

dry mixing an active agent, preferably in salt form, a filling agent, a lubrication agent, a pH-adjuster, a sweetener, and optionally sodium chloride and a taste or flavor enhancer;

adding a matrix forming agent and optionally water; and collecting the resulting powder composition.

A fifth method comprises the steps of:

dry mixing a filling agent, a pH-adjuster, a sweetener, and optionally sodium chloride and a taste or flavor enhancer;

adding an active agent, preferably in salt form, a matrix forming agent, a lubrication agent, a taste or flavor enhancer and optionally water; and collecting the resulting powder composition.

A sixth method comprises the steps of:

dry mixing an active agent, preferably in salt form, a filling agent, a matrix forming agent, a pH-adjuster, a sweetener, and optionally sodium chloride and a taste or flavor enhancer;

adding a lubrication agent, a taste or flavor enhancer and optionally water; and collecting the resulting powder composition.

A seventh method comprises the steps of:

dry mixing an active agent, preferably in salt form, a filling agent, a matrix forming agent, a pH-adjuster in freeform, a microencapsulated pH adjuster, a sweetener, a powdered flavor enhancer and optionally sodium chloride and an additional taste or flavor enhancer;

adding a lubrication agent, a taste or flavor enhancer and optionally water; and collecting the resulting powder composition.

In embodiments of the described methods the active agent is preferably nicotine (in solution or in salt form) the filling agent is preferably water insoluble and water soluble microcrystalline cellulose; the matrix forming agent preferably a salt of alginate; the lubrication agent is preferably glycerol; the pH adjuster is preferably sodium bicarbonate; the sweetener can be acesulfame K and the taste or flavor enhancers can be selected from earlier parts of this description.

In embodiments of the described methods, the active agent is preferably nicotine (in solution or in salt form) present in an amount of 0.5 to 4 wt % the filling agent is preferably water insoluble and water soluble microcrystalline cellulose and present in at least 60 wt %; the matrix forming agent preferably a salt of alginate and present in amount of 0.5 to 5 wt %; the lubrication agent is preferably glycerol and present in amount of 0.5 to 3% wt %, the pH adjuster is preferably sodium bicarbonate and present in amount of 0.1 to 10 wt %; the sweetener can be acesulfame K and the taste or flavor enhancers can be selected from earlier parts of this description and are present in minor amounts such as 1-3 wt %. All amounts give relate to the finally collected powder particle composition.

DETAILED AND EXAMPLING DESCRIPTION OF THE INVENTION

FIG. 1 shows release data of nicotine for compositions according to the invention also in comparison with conventional tobacco based products.

The following experimental section demonstrates non-limiting examples of how to manufacture powder compositions according to the invention.

Example 1

In Example 1 a batch of 250 g powder composition according to the invention with about 7% (wt) water content was produced with the components and amounts in Table 1.

| | | |
|---|---|---|
| A | MCC (soluble or unsoluble) | 85.0% |
| | ALGINATE | 1.0% |
| | Sodium chloride | 3.0% |
| | Glycerol | 1.0% |

-continued

| | | |
|---|---|---|
| B | Sodium Bicarbonate | 0.3% |
| | Water | 3.5% |
| C | Water | 3.5% |
| | Acesulfame K | 0.2% |
| | Mint | 2.0% |
| | Optionally Ammonium Chloride | 0.0% |
| | Nicotine Liquid Form | 0.6% |

Table 1

The components A were weighed and mixed in a blender during a suitable period. The components B were weighed, mixed and slowly added to the blender to obtain a homogenous mixture. The components C were weighed, mixed and slowly added to the blender with A and B to obtain a homogenous mixture of A, B and C. The resulting mixture was carefully sieved to avoid aggregations and the powder composition was collected and packaged in batches of 5-10 gram.

Example 2

In Example 2 a batch of 250 g powder composition according to the invention was produced with the components and amounts in Table 2.

| | | |
|---|---|---|
| A | MCC | 85.00% |
| | Sodium choride | 3.0% |
| | Glycelrol | 1.0% |
| B | Sodium bicarbonate | 0.3% |
| | Water | 3.5% |
| C | Water | 3.5% |
| | Acesulfame K. | 0.2% |
| | Optionally Ammonium Chloride | 0.0% |
| D | Nicotine Liquid Form | 0.60% |
| | ALGINATE | 1.0% |
| | Mint | 2.0% |

Table 2

The components A were weighed and mixed in a blender during a suitable period. The components B were weighed, mixed and slowly added to the blender to obtain a homogenous mixture. The components C were weighed, mixed and slowly added to the blender with A and B to obtain a homogenous mixture of A, B and C. The components D were weighed, mixed and slowly added to the blender to obtain a homogenous mixture of A, B, C and D.

The resulting mixture was carefully sieved to avoid aggregations and the powder composition was collected and packaged in batches of 5-10 gram.

Example 3

In Example 3, a batch of 250 g powder composition according to the invention was produced with the components and amounts in Table 3. In contrast to Example 1 and 2, a slurry or paste is formed that dried and processed to the powder composition with about 7% (wt) water content. The filling agent in Example 3 was a water soluble colloid MCC with the trade name FEIYUN XW591.

| | | |
|---|---|---|
| A | MCC soluble/Gel forming | 61.8% |
| | Sodium chloride | 3.0% |
| | Glycelrol | 1.0% |
| B | Sodium Bicarbonate | 0.3% |
| | Water | 10.0% |

-continued

| | | |
|---|---|---|
| C | Water | 20.0% |
| | Acesulfame K | 0.2% |
| | Optionally Ammonium Chloride | 0.0% |
| | Potassium sorbate | 0.2% |
| D | Nicotine Liquid Form | 0.6% |
| | ALGINATE | 1.0% |
| | Mint | 2.0% |

Table 3

The components A were weighed and mixed in a blender during a suitable period. The components B were weighed, mixed and slowly added to the blender to obtain a homogenous mixture. The components C were weighed, mixed and slowly added to the blender with A and B to obtain a homogenous mixture of A, B and C. The components D were weighed, mixed and slowly added to the blender to obtain a homogenous mixture of A, B, C and D. The resulting paste is collected carefully sieved to avoid aggregations, dried overnight and milled to suitable particle size in the range of 0.01-0.1 mm. The resulting powder composition was collected and packaged in batches of 5-10 gram.

Example 4

In Example 4, a batch of 250 g powder composition according to the invention was produced with the components and amounts in Table 4 in a dry mixing process.

| | | |
|---|---|---|
| A | MCC | 91.4% |
| | Natrium Klorid | 3.0% |
| | Glycerol | 1.0% |
| | Sodium bicarbonate | 0.3% |
| | Acesulfame K | 0.2% |
| | OptionallyAmmonium Choride | 0.0% |
| | Nicotine Salt | 1.2% |
| B | ALGINATE | 1.0% |
| | Mint | 2.0% |
| | Optionally water | 0.0% |

Table 4

The components A were weighed and mixed in a blender during a suitable period. The components B were weighed, mixed and slowly added to the blender to obtain a homogenous mixture, optionally with water added. The resulting mixture was collected and carefully sieved to avoid aggregations and packaged 5-10 g batches.

Example 5

In Example 5, a batch of 250 g powder composition according to the invention was produced with the components and amounts in Table 5 in a dry mixing process

| | | |
|---|---|---|
| A | MCC | 91.4% |
| | Sodium chloride | 3.0% |
| | Sodium Bicarbonate | 0.3% |
| | Acesulfame K | 0.2% |
| | Optionally ammonium chloride | 0.0% |
| B | ALGINATE | 1.0% |
| | Nicotine Salt | 1.2% |
| | Mint | 2.0% |
| | Optionally water | 0.0% |
| | Glycelrol | 1.0% |

Table 5

The components A were weighed and mixed in a blender during a suitable period. The components B were weighed, mixed and slowly added to the blender to obtain a homogenous mixture, optionally with water added. The resulting mixture was collected and carefully sieved to avoid aggregations and packaged in 5-10 g batches.

Example 6

In Example 6, a batch of 250 g powder composition according to the invention was produced with the components and amounts in Table 6 in a dry mixing process

| | | |
|---|---|---|
| A | MCC | 91.4% |
| | Sodium chloride | 3.0% |
| | Sodium Bicarbonate | 0.3% |
| | Acesulfame K | 0.2% |
| | Optionally ammonium chloride | 0.0% |
| | Alginate | 1.0% |
| | Nicotine Salt | 1.2% |
| B | Mint | 2.0% |
| | Optionally water | 0.0% |
| | Glycerol | 1.0% |

Table 6

The components A were weighed and mixed in a blender during a suitable period. The components B were weighed, mixed and slowly added to the blender to obtain a homogenous mixture, optionally with water added. The resulting mixture was collected and carefully sieved to avoid aggregations and packaged in 5-10 g batches.

Example 7

In Example 7, a batch of 250 g powder composition according to the invention was produced with the components and amounts in Table 7 in a dry mixing process.

| | | |
|---|---|---|
| A | MCC | 90.2% |
| | Sodium chloride | 3.0% |
| | Sodium carbonate free | 0.3% |
| | Sodium carbonate. microencasulated | 0.15% |
| | Acesulfame K | 0.2% |
| | Optionally ammonium chloride | 0.0% |
| | ALGINATE | 1.0% |
| | Mint powder | 1.0% |
| | Nicotine Salt | 1.2% |
| B | Mint | 2.0% |
| | Glycerol | 1.0% |

Table 7

The components A were weighed and mixed in a blender during a suitable period. The components B were weighed, mixed and slowly added to the blender to obtain a homogenous mixture, optionally with water added. The resulting mixture was collected and carefully sieved to avoid aggregations and packaged in 5-10 g batches.

Example 8

In Example 8, a batch of 250 g powder composition according to the invention was produced with the components and amounts in Table 8 in a dry mixing process The components A were weighed and mixed in a blender during a suitable period. The components B were weighed, mixed and slowly added to the blender to obtain a homogenous mixture, optionally with water added. The resulting mixture was collected and carefully sieved to avoid aggregations and packaged in 5-10 g batches.

| | | |
|---|---|---|
| A | Sodium starch glycolate | 91.4% |
| | Sodium chloride | 3.0% |
| | Glycerol | 1.0% |
| | Sodium carbonate | 0.3% |
| | Acesulfame K | 0.2% |
| | Optionally Ammonium chloride | 0.0% |
| | Nicotine Salt | 1.2% |
| B | ALGINAT | 1.0% |
| | Mint | 2.0% |
| | optionally water | 0.0% |

Table 8

Example 9

In Example 9, a batch of 250 g powder composition according to the invention was produced with the components and amounts in Table 9

| | |
|---|---|
| Alginate | 61.8% |
| Sodium chloride | 3.0% |
| Glycerol | 1.0% |
| Sodium bicarbonate | 0.3% |
| Water | 10.0% |
| Water | 20.0% |
| Acesulfame K | 0.2% |
| Optionally Ammonium chloride | 0.0% |
| Potassium sorbate | 0.2% |
| Nicotine Liquid Form | 0.6% |
| ALGINATE | 1.0% |
| Mint | 2.0% |

Table 9

The first three components were weighed and mixed in a blender during a suitable period. Water and bicarbonate were added to the blender to homogeneity Water, acesulfame K, potassium sorbate and optionally ammonium chloride were weighed and added to the blender to homogeneity. Nicotine, alginate and mint were weighed and added to the blender to homogeneity. The resulting mixture was collected and carefully sieved to avoid aggregations and dried overnight to a desired water level.

Example 10

In Example 10, a batch of 250 g powder composition according to the invention was produced with the components and amounts in Table 10.

| | |
|---|---|
| Sodium starch gluconate | 85.0% |
| ALGINATE | 1.0% |
| Sodium chloride | 3.0% |
| Glycelrol | 1.0% |
| Sodium bicarbonate | 0.3% |
| Water | 3.5% |
| Water | 3.5% |
| Acesulfame K | 0.2% |
| Mint | 2.0% |
| Optionally ammonium chloride | 0.0% |
| Nicotine Liquid Form | 0.6% |

Table 10

As previously, the three batches of components were individually weighed and blended before successively added to blender and mixed to homogeneity. The resulting mixture was sieved and packaged according to procedure in previous Examples.

Example 11

In order to study the nicotine release from powder particle compositions according to the invention compositions 11.1 to 11.9 was prepared as above. Three commercially available references were used: Gawith, Ozona and McChrystal's. All were tobacco based and intended for nasal use.

In formulations 11.1 to 11.9, the alginate used was Satialgine S900 NS, the water insoluble MCC is HiCel 90M. and the water soluble MCC was XW-591 from Huzhou City Linghu Xinwang Chemical. Generally, the water content of the formulations was about 7 wt %. Liquid nicotine (base form) or the nicotine alt nicotine polyacrylex were alternatively used for comparison.

Formulations 11.1 to 11.9 were made according to process with steps A to E:

A: filling agent(s), alginate, sodium chloride and nicotine when present as a salt were combined in a dry mixer and suitably mixed;

B: Sodium bicarbonate, propylene glycol (PG) and water was mixed and put in the mixer and mixed to homogeneity;

C: sweetener, taste or flavor enhancer, water in an amount to reach the target of 7 wt %, and nicotine when present in liquid base form were mixed slowly put into the mixer and mixed to homogeneity;

D: the resulting mixture was sieved to avoid lumps or aggregates; and

E: the obtained powders were packages in batches of 5-10 g.

| | | | |
|---|---|---|---|
| 11.1 | A | MCC 100% soluble | 82.2% |
| | | Alginate | 2.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

| | | | |
|---|---|---|---|
| 11.2 | A | MCC 100% soluble | 78.8% |
| | | Alginate | 2.0% |
| | | Sodium chloride | 3.0% |
| | | Nicotine salt 20% | 4.2% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |

| | | | |
|---|---|---|---|
| 11.3 | A | MCC 100% soluble | 84.2% |
| | | Alginate | 0.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

| | | | |
|---|---|---|---|
| 11.4 | A | MCC non-soluble | 82.2% |
| | | Alginate | 2.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

| | | | |
|---|---|---|---|
| 11.5 | A | MCC non soluble | 78.8% |
| | | Alginate | 2.0% |
| | | Sodium chloride | 3.0% |
| | | Nicotine salt 20% | 4.15% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |

| | | | |
|---|---|---|---|
| 11.6 | A | MCC non soluble | 84.2% |
| | | Alginate | 0.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

| | | | |
|---|---|---|---|
| 11.7 | A | MCC soluble | 41.1% |
| | | MCC non soluble | 41.1% |
| | | Alginate | 2.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

| | | | |
|---|---|---|---|
| 11.8 | A | MCC soluble | 39.4% |
| | | MCC non soluble | 39.4% |
| | | Alginate | 2.0% |
| | | Sodium chloride | 3.0% |
| | | Nicotine salt 20% | 4.15% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |

| | | | |
|---|---|---|---|
| 11.9 | A | MCC soluble | 42.1% |
| | | MCC non soluble | 42.1% |
| | | Alginate | 0.0% |
| | | Sodium chloride | 3.0% |
| | B | Sodium bi-carbonate | 0.3% |
| | | PG | 2.0% |
| | | Water | 3.5% |
| | C | Water | 3.5% |
| | | Acesulfame K | 0.2% |
| | | Mint Flavour, Taiga | 2.5% |
| | | Nicotine liquid form | 0.83% |

Tables 11.1 to 11.9

For the tests, Petri dishes (Roth EL49.1) with 14.5 diameter were used. In each Petri dish a filter paper 110 mm diameter (Roth AP29.1) was saturated and continued with water for 15 minutes. The dishes were controlled to avoid air bubbles.

1.00 g of samples of each of compositions 11.1 to 11.9 were weighed centrifuge tubes and 47 mm filters (VWR SARTFT-3-01304-47) were put over and sealed with rubber bands over each tube. The tubes were turned upside down and put in the middle of the prepared wet Petri dishes and the filters and their powder contents were carefully loosened from the tubes.

The filters were removed at 5, 10, 15, 20, 35, 55 and 70 minutes. The filters were put in 50 ml centrifuge tubes with 25 ml 80% methanol in water and shaken for 30 minutes, centrifuged as for nicotine analysis and the liquid phases were analyzed on HPLC. The results are demonstrated in Table 12.

| Composition | t = 0 | t = 5 min Soluble % | t = 10 min Soluble % | t = 15 min Soluble % | t = 20 min Soluble % | t = 30 min Soluble % | t = 55 min Soluble % | t = 70 min Soluble % |
|---|---|---|---|---|---|---|---|---|
| 11.1 | 0 | 10 | 15 | 16 | 19 | 16 | 15 | 13 |
| 11.2 | 0 | 1 | 12 | 12 | 12 | 6 | 8 | 10 |
| 11.3 | 0 | 4 | 16 | 16 | 15 | 14 | 14 | 11 |
| 11.4 | 0 | 15 | 15 | 16 | 12 | 14 | 17 | 16 |
| 11.5 | 0 | 1 | 11 | 8 | 11 | 11 | 9 | 5 |
| 11.6 | 0 | 16 | 18 | 20 | 18 | 22 | 18 | 16 |
| 11.7 | 0 | 24 | 21 | 20 | 23 | 25 | 21 | 22 |
| 11.8 | 0 | 3 | 7 | 6 | 7 | 6 | 5 | 8 |
| 11.9 | 0 | 8 | 10 | 11 | 15 | 16 | 15 | 20 |
| Gawith | 0 | 14 | 16 | 16 | 15 | 15 | 17 | 20 |
| Ozona | 0 | 8 | 11 | 9 | 15 | 21 | 20 | 20 |
| McC Yellow | 0 | 17 | 16 | 26 | 17 | 19 | 18 | 20 |

Table 12

The results of Table 12 show that composition 11.7 with a mixture water insoluble and water soluble MCC and 2% sodium alginate provided a surprisingly fast nicotine delivery and released 24% of the nicotine in 5 minutes. In comparison, the formulation without sodium alginate released 8% of the nicotine. In further comparison, the tobacco based comparison products, released 8 to 17% of the nicotine in 5 minutes. It is also notable in that fluid nicotine resulted in better nicotine release than the salt nicotine polyacrylex in all formulations tested. It can be concluded that the matrix forming agent (sodium alginate) contributed to improve an early release in all formulations. It is also noted that formulations only based on water soluble MCC had a tendency form a gel lump with comparatively poor release. In further conclusion, the results show that the powder particle compositions of the invention meet requirements of admitting fast release of nicotine for user satisfaction and that matrix forming agent, here exemplified by alginate, is useful to modulate the release of nicotine.

In stability tests for 9 weeks at 40° C. 75% RH, compositions made according to the protocols above were compared with the snus products Lyft Liq (about 45 wt % water) and Zyn Spearmint (about 30 wt % water). The tests demonstrated a 15 wt % loss of nicotine and 2% pH loss, whereas the commercial snus products lost about 25 wt % of their nicotine contents and lost 4-6% in pH. These tests conclude that the inventive powder particle compositions also have a surprisingly high stability in addition the favorable release characteristics.

The invention claimed is:

1. A powder particle composition with a water content of 30 wt % or less, with an ISO brightness that is not less than about 60, preferably not less than about 70, and more preferably not less than about 80, as measured according to ISO 2470-1:2016, and with a pH of at least 6 for delivery of an active agent to the nasal cavity, wherein the active agent is at least one member selected from the group consisting of nicotine, tetrahydrocannabinol (THC) and ethanol, the composition also comprising, a filling agent, and a matrix forming agent and wherein it has (i) a water content of 30 wt % or less; and wherein (ii) the filling agent comprises at least a water insoluble microcrystalline cellulose (MCC) and at least a water-soluble microcrystalline cellulose (MCC).

2. The composition according to any claim 1, comprising at least 60 wt % filling agent.

3. The composition according to claim 1, wherein the filling agent comprises 5 to 90 wt % of the water insoluble MCC and 5 to 90 wt % of the water soluble MCC based on total weight of the filling agent.

4. The composition according to claim 1, further comprising at least one additional natural or synthetic fiber material.

5. The composition according to claim 4, wherein the filling agent further comprises tobacco fibers in amount of 0.05 to 20 wt %.

6. The composition according to claim 1, wherein the filling agent further comprises a at least one food or pharmaceutical grade polyol selected from the group consisting of mannitol, sorbitol, xylitol, erythritol, lactitol, and maltitol.

7. The composition according to claim 6, wherein up to 50 wt % of the filling agent is a polyol.

8. The composition according to claim 1, wherein the filling agent further comprises a at least one mucoadhesive agent selected from the group consisting of a cellulose derivative, a starch derivative and polyvinylpyrrolidone.

9. The composition according to claim 1, wherein the powder particles have an average size of 0.01 to 3 mm.

10. The composition according to claim 1, wherein the matrix forming agent is a gelling agent.

11. The composition according to claim 1, comprising 0.5 to 95 wt % of the matrix forming agent.

12. The composition according to claim 1, comprising 0.5 to 10 wt % of the matrix forming agent and at least 60 wt % filling agent.

13. The composition according to claim 11, wherein the matrix forming agent is a salt of alginate.

14. The composition according to claim 1, further comprising a lubricating agent.

15. The composition according to claim 1, further comprising at least one excipient selected from the group consisting of preservatives, taste or flavour enhancers, pH adjusters, plasticizers and sweeteners.

16. The composition according to claim 1, comprising 0.1 to 5 wt % of nicotine, the nicotine is at least one member selected from the group consisting of nicotine base and salts of nicotine.

17. The composition according to claim 1, further comprising an antioxidant effective at a pH of at least 6.

18. A product for nasal use, comprising the powder particle composition according to claim 1 and 1 to 5 wt % of support particles free from active agent.

19. The product according to claim 18, wherein the support particles add at least one product characteristic selected from the group consisting of visual appearance, a rheologic characteristic, capacity to lubricate the nasal cavity, and capacity to regulate the uptake of active agent.

20. The product according to claim 18, wherein the particles of the powder particle composition and the support have the same average size and comprises the same filling agent.

21. The product according to claim 20, wherein the support particles are microcapsules having an average size of 10 to 1000 μm.

22. The product according to claim 18, wherein the support particles are derived from tobacco fiber.

23. The composition according to claim 3, wherein the filling agent comprises 45 to 55 wt % of the water insoluble MCC and 45 to 55 wt % of the water soluble MCC based on the total weight of the filling agent.

* * * * *